US008413918B2

(12) United States Patent
Zhong

(10) Patent No.: US 8,413,918 B2
(45) Date of Patent: Apr. 9, 2013

(54) PAPER SHREDDER OVERLOAD BUFFERING DEVICE

(76) Inventor: Fengqiang Zhong, Guangzhou (CN)

( * ) Notice: Subject to any disclaimer, the term of this patent is extended or adjusted under 35 U.S.C. 154(b) by 234 days.

(21) Appl. No.: 13/010,752

(22) Filed: Jan. 20, 2011

(65) Prior Publication Data

US 2012/0024998 A1 Feb. 2, 2012

(30) Foreign Application Priority Data

Jul. 29, 2010 (CN) ..... 2010 2 0275436 U

(51) Int. Cl.
*B02C 23/00* (2006.01)

(52) U.S. Cl. ..... 241/100; 241/101.2

(58) Field of Classification Search ..... 241/101.2, 241/100, 236
See application file for complete search history.

(56) References Cited

U.S. PATENT DOCUMENTS 4,052,013 A * 10/1977 Ehrlich et al. ..... 241/101.2
4,082,232 A * 4/1978 Brewer ..... 241/236
4,919,345 A * 4/1990 Burlington et al. ..... 241/36
4,936,517 A * 6/1990 Kammerer et al. ..... 241/101.2
7,871,027 B2 * 1/2011 Ko ..... 241/100
8,157,014 B2 * 4/2012 Hariharan et al. ..... 166/357
2005/0199756 A1 * 9/2005 Kato et al. ..... 241/65
2006/0208116 A1 * 9/2006 Kofoed ..... 241/236

* cited by examiner

*Primary Examiner* — Faye Francis
(74) *Attorney, Agent, or Firm* — George D. Liu; Ronda IP Agent Co., Ltd

(57) ABSTRACT

A buffering device of the invention includes a motor and a drive cutter shaft driven by the motor. Mounted on the drive cutter shaft are a drive cutter gear, a buffering disc, and a buffering gear. The buffering disc contains a cylindrical portion. A shifting block is extended from the cylindrical portion. A receiving hole is defined in the buffering gear. Plural recesses are extended from the circumferential inner wall. The cylindrical portion is inserted into the circumferential inner wall, while the shifting blocks are placed into recesses. A circumferential gap is defined between the shifting block and a recess. By this way, the gear components or motor are protected from being damaged due to overload, hence making it possible to protect the mechanical components and motor of the paper shredder.

4 Claims, 2 Drawing Sheets

PAPER SHREDDER OVERLOAD BUFFERING DEVICE

FIELD OF THE INVENTION

The invention relates to a paper shredder and more particularly, relates to a paper shredder overload buffering device.

BACKGROUND

For a conventional paper shredder, protection for its mechanical components such as gears, cutter and motor is impossible in case that overload occurs. In other words, when an excessive quantity of papers are loaded into the shredder, machine malfunctions such as machine jamming, gear slipping may occur due to over-thickness of papers. In worse cases, the motor will get problematic, for example the motor may be burned.

SUMMARY OF THE INVENTION

One object of the invention is to provide a paper shredder overload buffering device capable of effectively protecting the mechanical parts as well as the motor of the shredder when overload happens, thus preventing malfunctions such as gear slippery and/or burn of the motor from happening. By this way, the paper shredder is protected from overload.

To realize the above object, a paper shredder overload buffering device is provided.

The buffering device of the invention includes a motor and a drive cutter shaft driven by the motor. Mounted on the drive cutter shaft are a drive cutter gear, a buffering disc coaxial with and capable of rotating with the drive cutter gear, and a buffering gear which movably surrounding the outer portion of the buffering disc. The buffering disc contains a cylindrical portion. At least a shifting block is extended from an outer circumferential surface of the cylindrical portion. A receiving hole is defined at the center of the buffering gear by a circumferential inner wall of the buffering gear. A number of recesses are extended diametrically outwardly from the circumferential inner wall. The number of the recesses is the same as the buffering disc. The cylindrical portion is movably inserted into the circumferential inner wall, while the shifting blocks are placed into respective recesses. In addition, a circumferential gap is defined between each shifting block and a corresponding recess along circumferential direction.

Compared with prior art devices, the invention can bring more advantages. For example, as the drive cutter shaft is equipped with a buffering disc and a buffering gear which surrounds the buffering disc and defines a circumferential gap between itself and the buffering disc, the motor will not immediately cause the shredder to perform paper shredding actions after start of the motor. Rather, the motor will at first render the buffering gear rotating a certain angle with respect to the buffering disc. After that, the motor drives the buffering disc to rotate, thereby realizing buffering function. By this way, the gear components or motor are protected from being damaged due to overload, hence making it possible to protect the mechanical components and motor of the paper shredder.

Other advantages and novel features will be drawn from the following detailed description of embodiments with attached drawings, in which:

DETAILED DESCRIPTION

Figure 1:
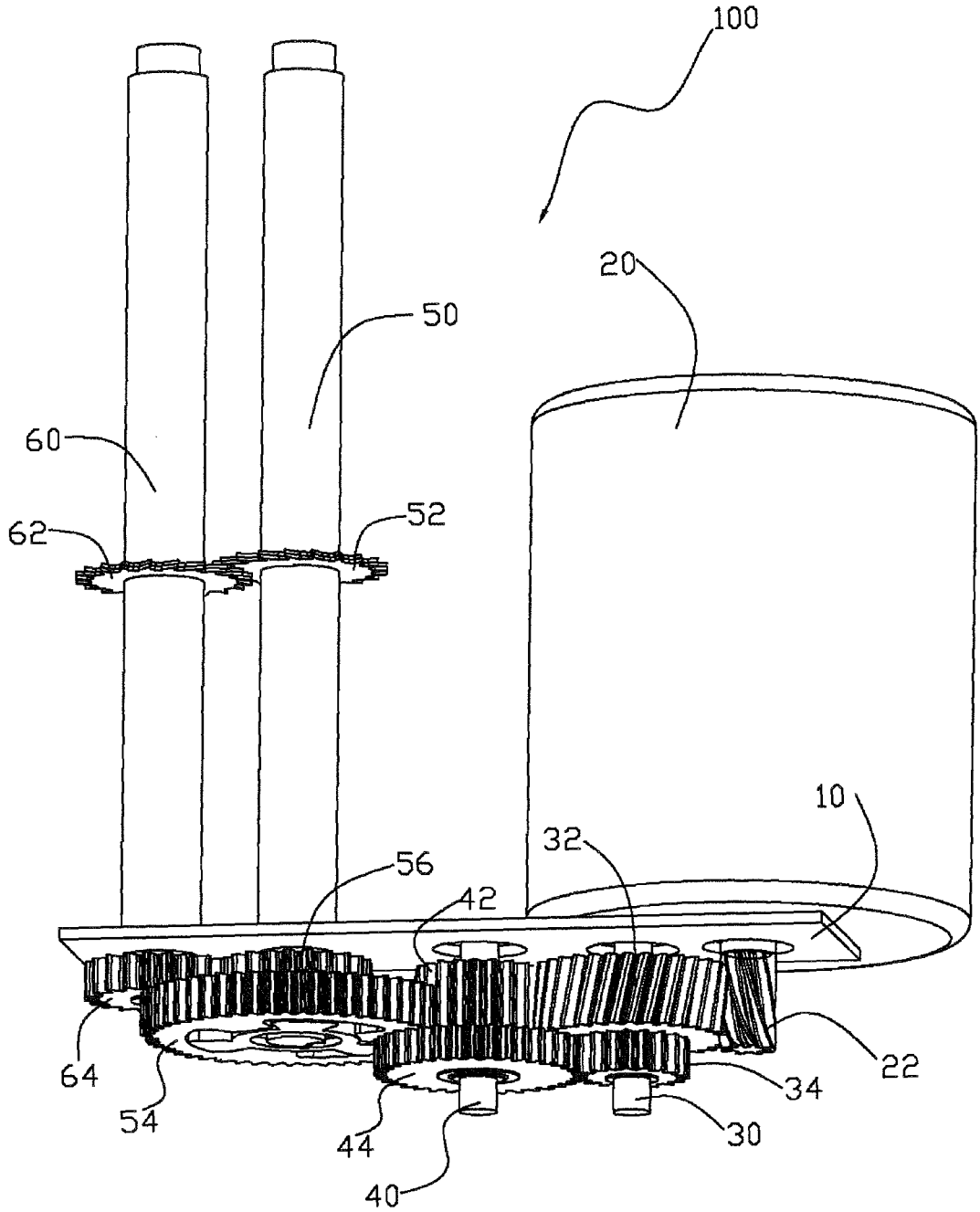
FIG. 1 shows a perspective view of a paper shredder overload buffering device according to one embodiment of the invention.
Figure 2:
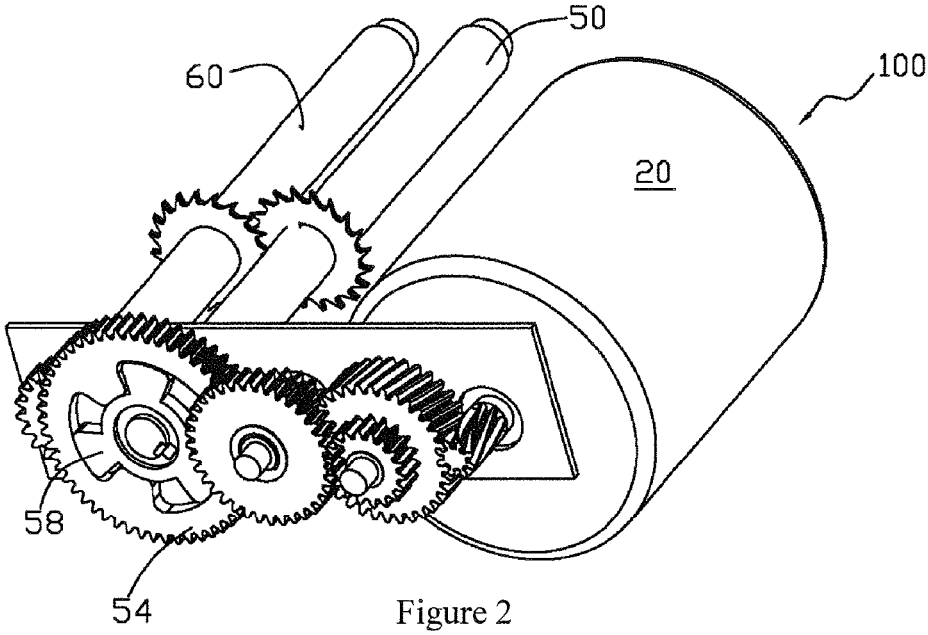
FIG. 2 shows from another angle a perspective view of the buffering device of FIG. 1, illustrating a buffering gear and a buffering disc received in a movable manner into the buffering gear.

Various embodiments of the invention will be discussed below with reference to accompanying drawings.

With reference to FIGS. 1-4 and according to one embodiment of the invention, a paper shredder overload buffering device 100 includes a motor 22 with an output shaft 22, a drive cutter shaft 50 driven by the output shaft 22 of the motor 20, and a driven cutter shaft 60 driven by the cutter shaft 50.

A drive cutter 52 is mounted on the drive cutter shaft 50. Similarly, a driven cutter 62 is installed on the driven cutter shaft 60. When the motor 20 is started, the output shaft 22 will drive the cutter shaft 50 to rotate and in turn, the cutter shaft 60 is driven to rotate. As a result, the cutters 52, 62 of the cutter shafts 50 and 60 will rotate to perform paper cutting operations.

Preferably, transmission between the motor output shaft 22 and drive cutter shaft 50 is implemented by a reduction gearset.

The paper shredder overload buffering device 100 further includes a mounting plate 10 through which the output shaft 22 of the motor passes. First and second intermediate shafts 30, 40 are installed on the mounting plate 10. A first driven gear 21 meshed with the output shaft 22, and a first coaxial gear 34 coaxial with and capable of rotating with the first driven gear 21 are mounted on the first intermediate shaft 30. A second driven gear 44 meshed with the first coaxial gear 34, and a second coaxial gear 42 coaxial with and capable of rotating with the second driven gear 44 are mounted on the first intermediate shaft 30.

The first intermediate shaft 30, a first driven gear 21 mounted on the first intermediate shaft 30 and meshed with the output shaft 22, a first coaxial gear 34 coaxial with and capable of rotating together with the first driven gear 21, a second intermediate shaft 40, a second driven gear 44 mounted on the second intermediate shaft 40 and meshed with the first coaxial gear 34, and the second coaxial gear 42 coaxial with and capable of rotating together with the second driven gear 44 define cooperatively the reduction gearset.

Further, the drive cutter shaft 50 passes through the mounting plate 10. A drive cutter gear 56, a buffering disc 58 coaxial with and capable of rotating together with the drive cutter gear 56, and a buffering gear 54 which is movably surrounding an outer portion of the buffering disc 58 so as to engage the buffering disc 58, are provided on a portion which passes through the mounting plate 10, of the drive cutter shaft 50.

The driven cutter shaft 60 runs across the mounting plate 10. A driven cutter gear 64 is mounted on a portion which running across the mounting plate 10, of the driven cutter shaft 60.

The paper shredder overload buffering device 100 provided by the invention features its buffering disc 58 and buffering gear 54.

Now, detailed construction of and relationship between the buffering disc and buffering gear are described below with reference to FIGS. 3-4. Referring to FIG. 4, the buffering disc 58 has a cylindrical portion 582 on center of which an arbor hole 5822 is defined so as to mount therein a portion of the drive cutter shaft 50 extended outside the mounting plate 10, thus securing the buffering disc 58 onto the drive cutter shaft 50. Several sector-shaped shifting blocks such as three bocks 5824 are extended diametrically outwardly from the outer circumferential surface of the cylindrical portion 582. Each sector-shaped shifting block 5824 has a thickness in axial direction of the buffering disc 58, and has two radial sidewalls 5826 and an arc-shaped top wall 5828 interconnected with the two radial sidewalls 5826. It is noted that there may be only one sector-shaped shifting block 5824.

Figure 3:
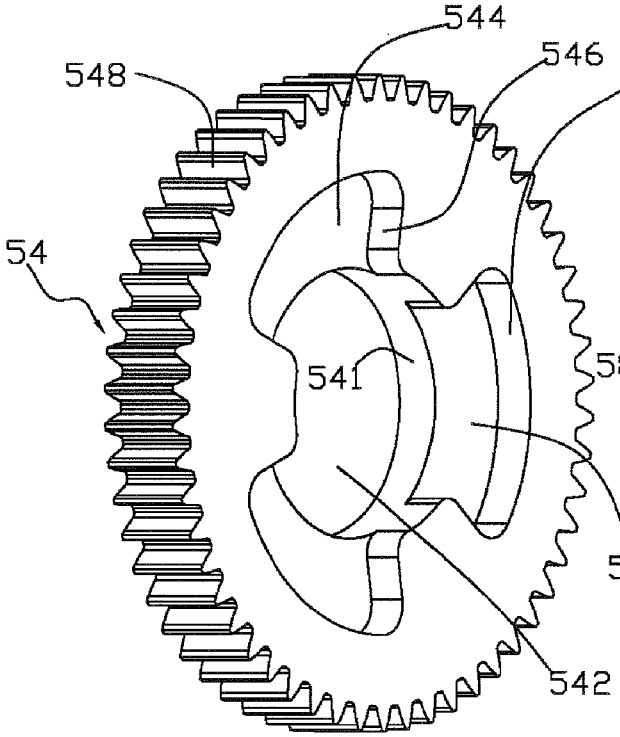
FIG. 3 shows a perspective view of the buffering gear of the buffering device of FIG. 2.
Figure 4:
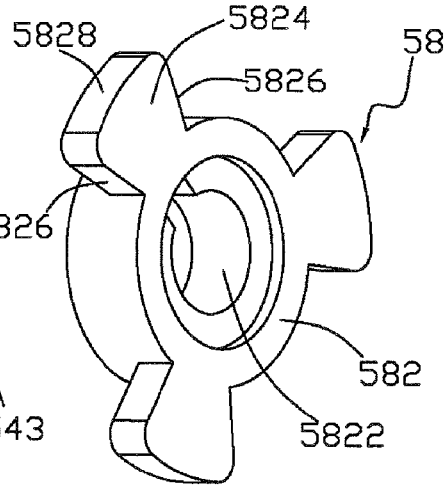
FIG. 4 shows a perspective view of the buffering disc of the buffering device of FIG. 2.

With reference to FIG. 3, a plurality of gear teeth 548 meshed with corresponding gear teeth of the second coaxial gear 42 is provided on an outer circumferential surface of the buffering gear 54. In addition, a receiving hole 542 defined by a circumferential inner wall 541 is provided in the center of the buffering gear 54 such that the cylindrical portion 582 of the buffering disc 581 can be received therein. Furthermore, at an end surface of the buffering gear 54, several recesses such as three recesses 544 (the number of the recesses is corresponding to that of the sector-shaped shifting blocks 5824 of the buffering disc 58) are defined diametrically outwardly from the circumferential inner wall 541 with the purpose of receiving the blocks 5824 therein. Each recess 544 is constituted by two contacting walls 546, an arc-shaped inner wall 547, and a bottom wall 543 which interconnecting both of the contacting walls 546 and the arc-shaped inner wall 547.

The buffering gear 54 surrounds the buffering disc 58. More specifically, the cylindrical portion 582 is inserted into the circumferential inner wall 541. Each sector-shaped shifting block 5824 is held in respective recess 544. Concretely, the circumferential dimension of each sector-shaped shifting block 5824 is smaller than that of a corresponding recess 544 such that a circumferential gap is defined between the block 5824 and corresponding recess 544. When the motor 20 is started, the output shaft 22 drives the reduction gear set to operate. By this way, the buffering gear 54 is driven by the second coaxial gear 42. As the circumferential gap is defined between each sector-shaped shifting block 5824 and corresponding recess 544, the motor 20 will not immediately cause the cutters 52 and 62 to perform paper shredding actions after start of the motor 20. Rather, the motor 20 will at first render the buffering gear 54 rotating a certain angle with respect to the buffering disc 58. The buffering disc 58 will not be rotated until the contacting wall 546 contacts any one of the sidewalls 5826. By this way, the gear components or motor are protected from being damaged due to overload, hence making it possible to protect the mechanical components and motor of the paper shredder.

What is claimed is:

1. A paper shredder overload buffering device comprising a motor and a drive cutter shaft driven by the motor, wherein a drive cutter gear, a buffering disc coaxial with and capable of rotating with the drive cutter gear, and a buffering gear which movably surrounding the outer portion of the buffering disc are mounted on the drive cutter shaft;

the buffering disc comprises a cylindrical portion, and at least a shifting block is extended from an outer circumferential surface of the cylindrical portion;

a receiving hole is defined at the center of the buffering gear by a circumferential inner wall of the buffering gear; a number of recesses are extended diametrically outwardly from the circumferential inner wall; and the number of the recesses is the same as the shifting blocks;

the cylindrical portion is movably inserted into the circumferential inner wall, while the shifting blocks are placed into respective recesses; and a circumferential gap is defined between each shifting block and a corresponding recess along circumferential direction.

2. The paper shredder overload buffering device according to claim 1, wherein the at least one shifting block has two radial sidewalls and an arc-shaped top wall interconnecting the two radial sidewalls.

3. The paper shredder overload buffering device according to claim 1, wherein each recess is constituted by two contacting walls, an arc-shaped inner wall, and a bottom wall which interconnecting both of the contacting walls and an arc-shaped inner wall.

4. The paper shredder overload buffering device according to claim 1, wherein the shifting block is a fan-shaped shifting block.

* * * * *